United States Patent [19]

Cook et al.

[11] 3,991,821

[45] Nov. 16, 1976

[54] HEAT EXCHANGE SYSTEM

[75] Inventors: Neal A. Cook; Norman F. Costello; Dennis C. Granetzke, all of Racine, Wis.

[73] Assignee: Modine Manufacturing Company, Racine, Wis.

[22] Filed: Dec. 20, 1974

[21] Appl. No.: 534,873

[52] U.S. Cl. ..... 165/103; 165/159; 122/20 B

[51] Int. Cl.[2] ..... F28F 27/00

[58] Field of Search ..... 165/103, 102, 101, 37, 165/36, 35, 159, 161; 122/20 B

[56] References Cited

UNITED STATES PATENTS

| | | | |
|---|---|---|---|
| 2,052,856 | 9/1936 | Truelsen | 165/159 X |
| 2,729,433 | 1/1956 | Berg | 165/159 X |
| 3,392,777 | 7/1968 | Edgemond, Jr. et al. | 165/103 X |
| 3,499,484 | 3/1970 | Lanzoni | 165/159 |

FOREIGN PATENTS OR APPLICATIONS

| | | | |
|---|---|---|---|
| 363,559 | 12/1931 | United Kingdom | 165/103 |

*Primary Examiner*—Albert W. Davis, Jr.
*Attorney, Agent, or Firm*—Wegner, Stellman, McCord, Wiles & Wood

[57] ABSTRACT

A heat exchange system for exchange between fluids such as water and air as in a heat recovery system in which a first fluid is passed through a first conduit which may be in the form of pipes and a second fluid such as air is passed through a second conduit that surrounds the first and including baffles for directing the second fluid in heat exchange contact flow between the spaced pipes and back into the air conduit. At least one of the baffles is shaped to be flow diverting to divert the flow of the second fluid laterally over the first conduit and back toward the center of the second conduit so as to provide an undulating flow.

7 Claims, 4 Drawing Figures

HEAT EXCHANGE SYSTEM

BACKGROUND OF THE INVENTION

In many instances it is necessary to exchange heat between two fluids. A good example of this is a recuperator for recovering heat as in a preheater for air from a hot liquid. Another example is the recovery of heat from a furnace gas to preheat a liquid. Thus the heat exchange system of this invention is ideally suited as a variable heat recovery system such as a recuperator for recovering heat from a furnace exhaust which in some instances may be as high as 2000° F. or higher.

With the system of this invention the amount of recovered heat can be controlled in line with the heat requirements by the use of movable baffles or dampers. Thus if the exhaust is at the above 2000° F. this heat can be recovered to preheat a fluid. If, however, the recovery is to heat the air for supplying heat to a worker occupied space in a factory it may be that this amount of recoverable heat would be too high and therefore only a portion will be recovered.

One of the features of this invention is to provide a variable heat exchange system that can be used to transfer heat in controlled amounts from one fluid to another by the use of movable baffles or dampers.

DESCRIPTION OF THE PREFERRED EMBODIMENTS

Figure 1:
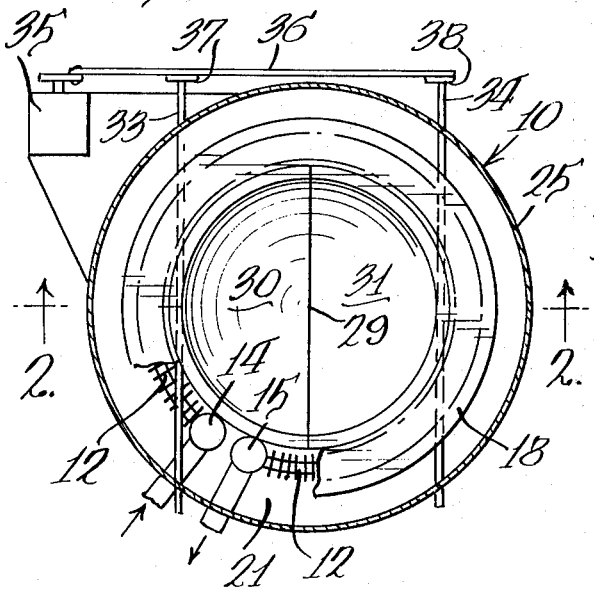
FIG. 1 is a sectional view taken substantially along line 1—1 of FIG. 2.
Figure 2:
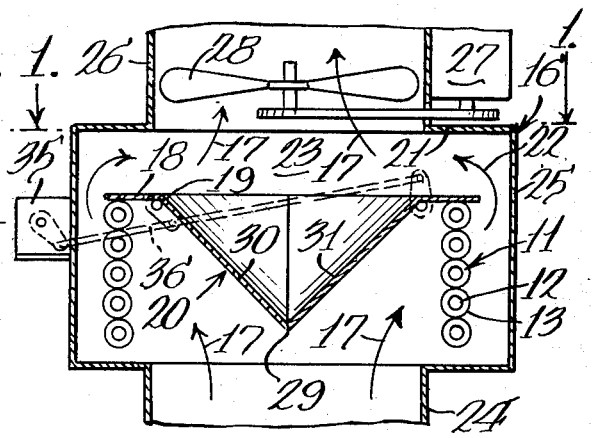
FIG. 2 is a transverse sectional view taken substantially along line 2—2 of FIG. 1.
Figure 3:
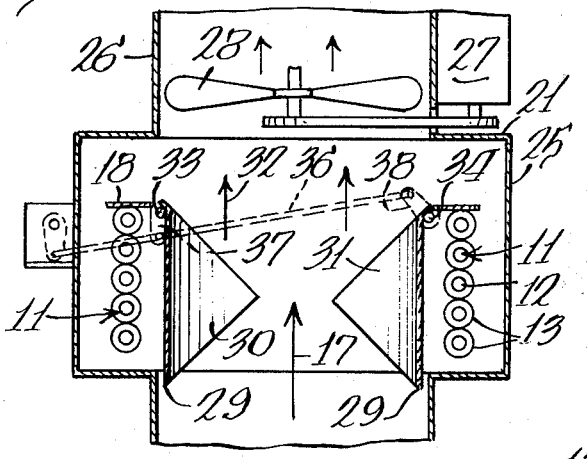
FIG. 3 is a view similar to FIG. 2 but showing the diverting second baffle or damper in open position.

In the embodiment of FIGS. 1, 2 and 3 the system 10 for heat exchange between separate flowing fluids comprises a first conduit 11 having spaced passages which here are in the form of spaced pipes 12 provided with heat exchange fins 13 for flow through the conduit of a first fluid which in this instance may be water.

The pipes 12 are supplied with first fluid, or in this instance liquid, through a first header 14 for parallel flow through the pipes 12 with each pipe describing substantially a circle. One end of each pipe 12 is attached to a header 14 and the other end of each pipe is attached to a second or exit header 15. Such a header and arcuate pipe arrangement is illustrated in U.S. Pat. No. 2,346,410.

Surrounding the first conduit 11 assembly of pipes 12 and fins 13 is a second conduit 16 for a second fluid 17 which in this embodiment may be air. Within the second conduit 16 in the region of the first conduit 11 is a flow directing first baffle 18 that as illustrated in FIG. 2 extends transversely to the second conduit 16 in the region of the first conduit 11 or in this embodiment adjacent the downstream end of the first conduit 11 relative to the direction of fluid flow 17. This first baffle 18 is provided with a fluid flow opening 19 that is substantially concentric to the annular first baffle 18 and to the cylindrically arranged first conduit 11 in this embodiment.

In order to direct the flow of the second fluid 17 as indicated by the arrows in FIG. 2 there is provided a flow diverting second baffle 20 within the opening 19 having a flow diverting portion 29 extending from the first baffle 18 upstream of the direction of flow 17 for diverting the second fluid 17 laterally from between the first conduit passages or pipes 12 for heat exchange therewith. There is also provided a fluid directing third baffle 21 which in the embodiment of FIG. 2 is at a downstream end of the vertical housing 25 that forms a part of the second conduit 16. This third baffle 21 directs the fluid indicated by the arrow 22 back into the main part 23 of the second conduit 16. Thus the second baffle 20 in combination with the third baffle 21 first directs the fluid 17 laterally between the pipes 12 as indicated by the arrows 17 for heat exchange therewith and then back around the outer edge of the first baffle 18 into the main part of the second conduit 16. As can be seen, the first baffle 18 is in the form of an annulus with the outer edge overlapping and extending beyond the first conduit 11 and the inner edge providing a location for the flow diverting second baffle 20.

In order to provide fluid flow through the second conduit 16 there is provided an inlet duct 24 leading to the main casing 25, an outlet duct 26 therefrom and a motor 27 operated fan 28. The second baffle 20 comprises separable parts 30 and 31 that are symmetrical at the apex or flow diverting portion 29 with these parts when closed comprising the baffle 20 but when opened as illustrated in FIG. 3 providing straight through flow 32 for the second fluid 17. In this embodiment the opened baffle parts 30 and 31 shield the pipes of the first conduit 11 from the fluid 17 so that the fluid when it enters the outlet duct 26 is heated to a much lesser extent than is the fluid when the baffle parts are in the closed position of FIGS. 1 and 2. This provides a control of the amount of heat that is exchanged between the fluid in the pipes 12 and the fluid 17.

In order to open and close the baffle or damper parts 30 and 31 each is hingedly mounted at one end as indicated by the hinges 33 and 34 with the parts being moved by a motor 35 and connecting arms 36, 37 and 38 shown semi-schematically in the drawings.

Figure 4:
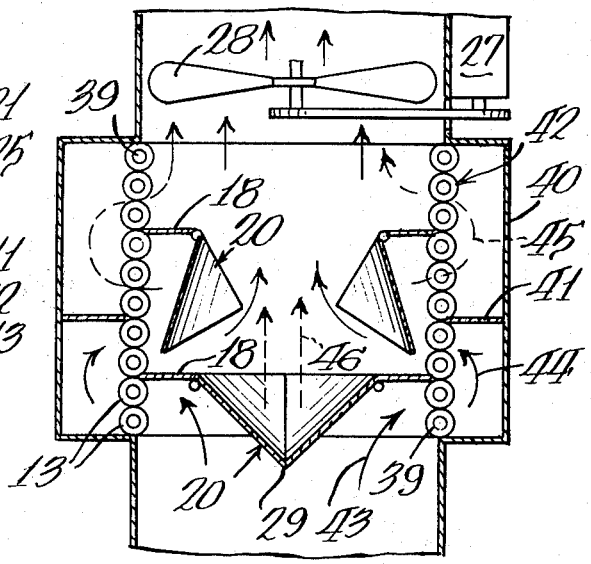
FIG. 4 is a view similar to FIGS. 2 and 3 but illustrating a second embodiment of the invention.

The embodiment of FIG. 4 is similar to that of FIGS. 1–3. In this embodiment, however, there is provided a larger number of fluid pipes 39 in the series and there are also provided a pair of first baffles 18 spaced along the second conduit 40 together with a flow directing additional baffle 41 of annular shape similar to the baffles 18 but extending from the outer side of the first conduit 42 to the adjacent side of the second conduit 40.

With the embodiment of FIG. 4 there is, of course, much greater diversity of operation of the heat exchange than is true with the first embodiment. Thus the second baffles 20 may be opened and closed independently of the other with the result that when both baffles 20 are closed the fluid flow 43 is outwardly through the first series of pipes, then inwardly as shown at 44 through the next series of pipes and again outwardly as shown by the broken line 45 through the next series and finally inwardly through the final series, thereby giving four passes through successive sets of pipes. When both second baffles 20 are open, then the flow is straight through as indicated by the broken line 46 in the same manner as when the baffle 20 is open in the FIG. 3 embodiment. Then when the lower baffle 20 is open and the upper baffle 20 is closed the flow follows the broken arrow 45. It is obvious, of course, that as many successive sets of baffles 18, 20 and 41 may be provided as desired to give the desired degree of versatility of operation.

Having described our invention as related to the embodiments shown in the accompanying drawings, it is our intention that the invention be not limited by any of the details of description, unless otherwise specified, but rather be construed broadly within its spirit and scope as set out in the appended claims.

We claim:

1. A system for heat exchange between separate flowing fluids, comprising: a first conduit having spaced passages for flow therethrough of a first said fluid; a second conduit for a second fluid enclosing said first conduit; a flow directing first baffle extending transversely to said second conduit in the region of said first conduit and having a fluid flow opening adjacent to said passages; a flow diverting second baffle means within said opening having a flow diverting portion extending from the first baffle upstream of the direction of flow of said second fluid for diverting said second fluid laterally between said first conduit passages for heat exchange therewith; and a fluid directing third baffle on the side of said first conduit that is opposite to said first baffle and downstream of said first baffle, the flow thereby being directed by said baffles laterally through said passages that are upstream of the first baffle and then laterally inwardly through the passages that are downstream of the first baffle back into said second conduit, said passages comprising pipes in a plurality of successive sets with each set having a combination of a said first baffle and a said second baffle and a third baffle located between each successive pair of said combinations, each said second baffle comprising separable parts that are movable away from each other to provide substantially unrestricted flow of said second fluid through said second conduit and to block substantial flow of said second fluid between said pipes in the area of said second baffle.

2. The system of claim 1 wherein said successive sets of pipes are provided with inwardly extending said first baffles alternating with outwardly extending said third baffles to provide with said second baffles an undulating flow path for the first fluid through said successive sets of pipes.

3. A system for heat exchange between separate flowing fluids, comprising: a first conduit having spaced passages for flow therethrough of a first said fluid; a second conduit for a second fluid enclosing said first conduit; a flow directing first baffle extending transversely to said second conduit in the region of said first conduit and having a fluid flow opening adjacent to said passages; a flow diverting second baffle means within said opening having a flow diverting portion extending from the first baffle upstream of the direction of flow of said second fluid for diverting said second fluid laterally between said first conduit passages for heat exchange therewith; and a fluid directing third baffle on the side of said first conduit that is opposite to said first baffle and downstream of said first baffle, the flow thereby being directed by said baffle laterally through said passages that are upstream of the first baffle and then laterally inwardly through the passages that are downstream of the first baffle back into said second conduit, each said second baffle means comprising separable parts that are movable away from each other to provide substantially unrestricted flow of said second fluid through said second conduit.

4. The system of claim 3 wherein said movable parts when in open position are arranged adjacent said passages of said first conduit to block second fluid flow therebetween.

5. The system of claim 3 wherein there are provided a plurality of said first, second and third baffles arranged in succeeding series along said first and second conduits.

6. A system for heat exchange between separate flowing fluids, comprising: a first conduit having spaced passages for flow therethrough of a first said fluid; a second conduit for a second fluid enclosing said first conduit; a flow directing first baffle extending transversely to said second conduit in the region of said first conduit and having a fluid flow opening adjacent to said passages; a flow diverting second baffle means within said opening having a flow diverting portion extending from the first baffle upstream of the direction of flow of said second fluid for diverting said second fluid laterally between said first conduit passages for heat exchange therewith; and a fluid directing third baffle on the side of said first conduit that is opposite to said first baffle and downstream of said first baffle, the flow thereby being directed by said baffles laterally through said passages that are upstream of the first baffle and then laterally inwardly through the passages that are downstream of the first baffle back into said second conduit, said spaced passages comprising spaced pipes of a said first conduit and said first and third baffles substantially intersect said first conduit, said second baffle comprising separable parts that are movable away from each other to provide substantially unrestricted flow of said second fluid through said second conduit and to block substantial flow of said second fluid between said pipes in the area of said second baffle.

7. A system for heat exchange between separate flowing fluids, comprising: a first conduit having spaced passages for flow therethrough of a first said fluid; a second conduit for a second fluid enclosing said first conduit; a flow directing first baffle extending transversely to said second conduit in the region of said first conduit and having a fluid flow opening adjacent to said passages; a flow diverting second baffle means within said opening having a flow diverting portion extending from the first baffle upstream of the direction of flow of said second fluid for diverting said second fluid laterally between said first conduit passages for heat exchange therewith; and a fluid directing third baffle on the side of said first conduit that is opposite to said first baffle and downstream of said first baffle, the flow thereby being directed by said baffles laterally through said passages that are upstream of the first baffle and then laterally inwardly through the passages that are downstream of the first baffle back into said second conduit, there being a plurality of said first, second and third baffles arranged in succeeding series along said first and second conduits, said second baffle comprising separable parts that are movable away from each other to provide substantially unrestricted flow of said second fluid through said second conduit and to block substantial flow of said second fluid between said passages in the area of said second baffle.

* * * * *